US006677907B2

(12) United States Patent
Shoji et al.

(10) Patent No.: US 6,677,907 B2
(45) Date of Patent: Jan. 13, 2004

(54) ANTENNA DEVICE AND PORTABLE TERMINAL

(75) Inventors: Hideaki Shoji, Hyogo (JP); Yasuhito Imanishi, Hyogo (JP); Toru Fukasawa, Hyogo (JP); Hiroyuki Ohmine, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/149,431

(22) PCT Filed: Oct. 31, 2000

(86) PCT No.: PCT/JP00/07637

§ 371 (c)(1),
(2), (4) Date: Jun. 24, 2002

(87) PCT Pub. No.: WO02/39542

PCT Pub. Date: May 16, 2002

(65) Prior Publication Data

US 2003/0001786 A1 Jan. 2, 2003

(51) Int. Cl.[7] ..... H01Q 1/24; H01Q 1/38

(52) U.S. Cl. ..... 343/702; 343/700 MS; 343/895

(58) Field of Search ..... 343/700 MS, 702, 343/795, 895, 725

(56) References Cited

U.S. PATENT DOCUMENTS

| | | | | |
|---|---|---|---|---|
| 6,225,951 | B1 * | 5/2001 | Holshouser et al. | 343/700 MS |
| 6,337,663 | B1 * | 1/2002 | Chi-Ming | 343/702 |
| 6,337,667 | B1 * | 1/2002 | Ayala et al. | 343/795 |
| 6,346,916 | B1 * | 2/2002 | Odachi et al. | 343/702 |
| 6,417,816 | B2 * | 7/2002 | Sadler et al. | 343/795 |
| 6,456,250 | B1 * | 9/2002 | Ying et al. | 343/702 |
| 6,459,413 | B1 * | 10/2002 | Tseng et al. | 343/702 |
| 6,559,803 | B2 * | 5/2003 | Shinichi | 343/702 |

FOREIGN PATENT DOCUMENTS

| | | |
|---|---|---|
| EP | 000924797 | 6/1999 |
| JP | 057618/1982 | 4/1982 |
| JP | 06-318814 | 11/1994 |
| JP | 10-303637 | 11/1998 |
| JP | 11-274828 | 10/1999 |

* cited by examiner

*Primary Examiner*—Tan Ho
(74) *Attorney, Agent, or Firm*—Oblon, Spivak, McClelland, Maier & Neustadt, P.C.

(57) ABSTRACT

An antenna device (3*a*) includes a substrate (11) and an antenna (21) provided on the substrate (11) and having an electrical length of $(\lambda/2)\times A$ (A is an integer). The antenna (21) includes a plate antenna (21*b*) positioned at a portion where an electrical length from an end portion (21*d*) is approximately $\lambda/4+(\lambda/2)\times B$ (B is an integer), and a meander line antenna (21*a*, 21*c*) connected to the plate antenna (21*b*).

8 Claims, 15 Drawing Sheets

ANTENNA DEVICE AND PORTABLE TERMINAL

TECHNICAL FIELD

The present invention relates to an antenna device and a mobile terminal and more particularly to an antenna device contained in a mobile phone and a mobile phone using the antenna device.

BACKGROUND ART

Antennas contained in housings of mobile phones are conventionally known as receiving/transmitting antennas for the mobile phones.

These antennas are classified into linear antennas and plate antennas depending on their characteristics.

FIG. 20 is a schematic plan view of a mobile phone containing a dipole antenna that is one of conventional linear antennas. Referring to FIG. 20, a conventional mobile phone 1*x* has a housing 10 and an antenna device 3*x* accommodated in housing 10. Antenna device 3*x* has a substrate 11 and a dipole antenna 121 provided on substrate 11. Dipole antenna 121 has two meander-like antenna portions 121*a* and 121*b* respectively connected to a feed point 12. The electrical length of dipole antenna 121 is λ/2.

During a call, the direction in which such a dipole antenna 121 extends (the direction indicated by an arrow 125) is approximately at a 30° angle with respect to a vertical direction. Therefore, dipole antenna 121 is known as an antenna which allows for reduction of polarization loss for a wave polarized vertically to the ground (a vertically polarized wave) at the time of a call.

FIG. 21 is a diagram showing a radiation pattern of the conventional dipole antenna shown in FIG. 20. As shown in FIG. 21, when mobile phone 1*x* is placed upright, particularly when the electrical length of the antenna is λ/2×A (A is an integer), a null point 134 of the radiation pattern as indicated by solid lines 131 and 132 is in a horizontal plane. This disadvantageously reduces the gain.

FIG. 22 is a graph showing the relation between the electrical length of the antenna and the current distribution on the antenna element in the conventional dipole antenna. As shown in FIG. 22, in the dipole antenna having an electrical length of λ/2, the maximum value of the current distribution exists at the portion where the electrical length of the antenna is λ/4, that is, at the central portion of the antenna. As a hand easily touches this portion, an antenna gain degrades particularly when a hand touches it.

FIG. 23 is a plan view of a mobile phone having a conventional plate antenna. Referring to FIG. 23, a mobile phone 1*y* has a housing 10 and an antenna device 3*y* accommodated in housing 10. Antenna device 3*y* has a substrate 11 and a plate antenna 122 provided on substrate 11. Plate antenna 122 is connected to a feed point 12.

Such a plate antenna 122 easily receives and transmits both a vertically polarized wave and a horizontally polarized wave with respect to the ground. Advantageously, degradation amount of gains when a finger touches the antenna is small as compared with a linear antenna, since the current in the vicinity of the feed point is dispersed.

Plate antenna 122, however, for example a patch antenna, requires about λ as the total perimeter of the antenna, the size of the antenna inevitably increases and thus mobile phone 1*y* itself increases in size.

The present invention is therefore made to solve the above problems. An object of the present invention is to provide an antenna device capable of receiving and transmitting both a vertically polarized wave and a horizontally polarized wave, being reduced in size and having small gain degradation during a call.

DISCLOSURE OF THE INVENTION

An antenna device in accordance with the present invention includes a substrate and an antenna provided on the substrate and having an electrical length of approximately (λ/2)×A (A is an integer). The antenna includes a plate antenna portion positioned at a portion where an electrical length from an end portion is approximately λ/4+(λ/2)×B (B is an integer), and a linear antenna portion connected to the plate antenna.

In the antenna device thus configured, the linear antenna portion can mainly receive and transmit either one of a vertically polarized wave or a horizontally polarized wave, and the plate antenna portion can receive and transmit both the vertically polarized wave and the horizontally polarized wave. As a result, both the vertically polarized wave and the horizontally polarized wave can be received and transmitted, resulting in a high gain antenna.

Furthermore, since the electrical length of the antenna is approximately (λ/2)×A (A is an integer), the current is large at the portion where the electrical length from the end portion of the antenna is approximately λ/4+(λ/2)×B (B is an integer). However, this portion is provided with the plate antenna portion and therefore the current can be distributed. Accordingly, even when a finger is placed on this portion, degradation in gain can be reduced.

Furthermore, since the antenna includes the linear antenna portion, the antenna can be reduced in size as compared with an antenna configured only with a plate antenna portion.

More specifically, the present invention can provide an antenna having a high gain even at the time of a call, assuring a gain when the terminal is placed upright, and having a small size.

Preferably, the linear antenna portion includes at least one selected from the group consisting of a monopole antenna, a zigzag antenna, a meander line antenna and a helical antenna.

More preferably, the substrate has a main surface having conductivity. The antenna further includes a connection portion connected to the main surface of the substrate. In this case, since the antenna is connected to the main surface having conductivity, an image is formed on the substrate. As a result, the electrical length of the antenna is approximately double the physical length of the antenna, so that the physical length of the antenna can be shortened. Therefore, the antenna device can be reduced in size.

Preferably, the substrate has a main surface and a side surface continuous with the main surface, and the antenna is provided on the side surface. In this case, since the main surface is not provided with an antenna, other device and the like can be placed on the main surface.

A mobile terminal in accordance with the present invention includes a housing and an antenna device contained in the housing. The antenna device includes a substrate and an antenna provided on the substrate and having an electrical length of approximately (λ/2)×A (A is an integer). The antenna includes a plate antenna portion positioned at a portion where an electrical length from an end portion is approximately λ/4+(λ/2)×B (B is an integer), and a linear antenna portion connected to the plate antenna portion.

In the mobile terminal thus configured, the linear antenna portion can mainly receive and transmit either one of a vertically polarized wave or a horizontally polarized wave and a plate antenna portion can receive and transmit both the horizontally polarized wave and the vertically polarized wave. As a result, both the vertically polarized wave and the horizontally polarized wave can be received and transmitted, resulting in a mobile terminal having a high gain antenna device.

Furthermore, since the electrical length of the antenna is approximately $(\lambda/2)\times A$ (A is an integer), the current is large at the portion where the electrical length from the end portion of the antenna is approximately $\lambda/4+(\lambda/2)\times B$ (B is an integer). However, since this portion is provided with the plate antenna portion, the current can be dispersed. Therefore, even when a finger or the like is placed on this portion, degradation in gain can be reduced.

Furthermore, the antenna includes the linear antenna portion, and thus the antenna and the mobile terminal can be reduced in size as compared with an antenna configured only with a plate antenna portion.

In addition, since the antenna device is contained in the housing, the antenna device is less affected by a human body. As a result, degradation in gain can be prevented.

BEST MODE FOR CARRYING OUT THE INVENTION

In the followings, embodiments of the present invention will be described with reference to the figures.

(First Embodiment)

Figure 1:
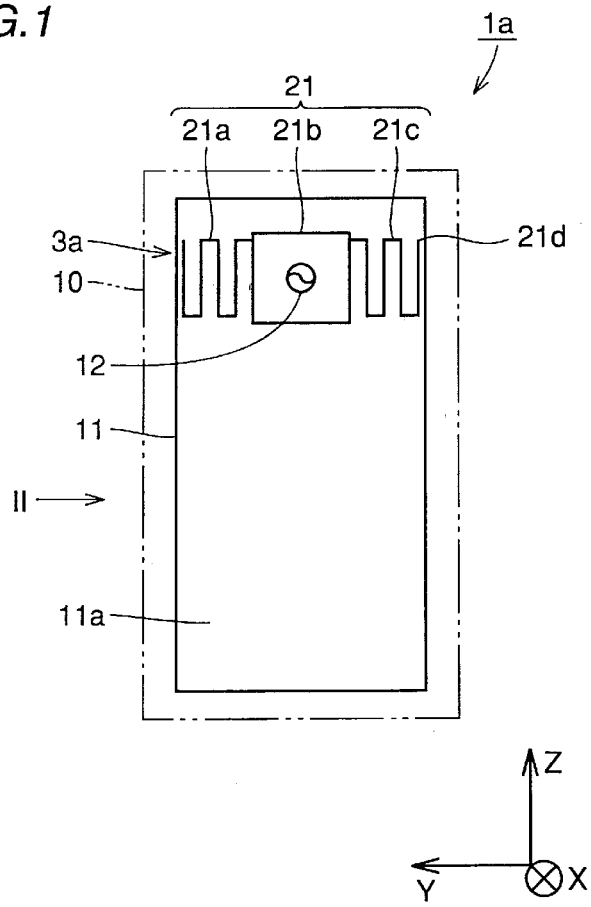
FIG. 1 is a schematic plan view of the mobile phone having the antenna device in accordance with a first embodiment of the present invention.
Figure 2:
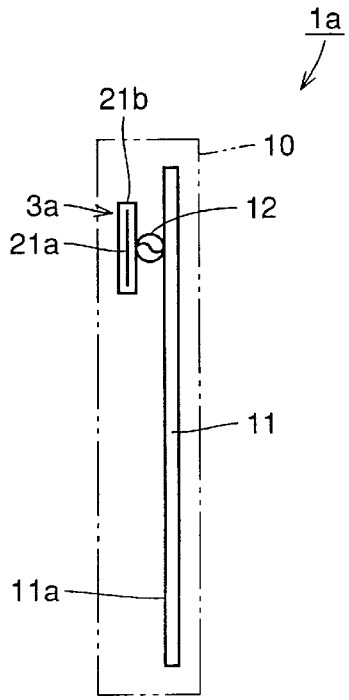
FIG. 2 is a side view of the mobile phone seen from a direction indicated by an arrow II in FIG. 1.

FIG. 1 is a schematic plan view of a mobile phone having an antenna device in accordance with a first embodiment of the present invention. FIG. 2 is a side view of the mobile phone seen from a direction indicated by an arrow II in FIG. 1. Referring to FIGS. 1 and 2, mobile phone 1*a* has a housing 10 and an antenna device 3*a* contained in housing 10. Antenna device 3*a* includes a substrate 11 and an antenna 21 provided on substrate 11 and having an electrical length of $(\lambda/2)\times A$ (A is an integer). Antenna 21 has a plate antenna 21*b* as a plate antenna portion positioned at a portion where an electrical length from an end portion 21*d* is approximately $\lambda/4+(\lambda/2)\times B$ (B is an integer), and meander line antennas 21*a* and 21*c* as a linear antenna portion connected to plate antenna 21*b*.

Substrate 11 is formed by depositing a high conductive metal such as copper on a prescribed insulating substrate. It is noted that the metal formed on the insulating substrate can be replaced by one having the same level of conductivity as copper. Substrate 11 extends in a longitudinal direction and has a rectangular shape. Antenna 21 is provided to extend along the short side of substrate 11.

Antenna 21 has plate antenna 21*b* as a plate antenna portion positioned at the central portion and meander line antennas 21*a* and 21*c* as a linear antenna portion positioned at opposing ends thereof. Plate antenna 21*b* is connected to feed point 12. Both meander line antennas 21*a* and 21*c* and plate antenna 21*b* are provided on a main surface 11*a* of substrate 11 as opposed to main surface 11*a*. Plate antenna 21*b* is connected to a radio unit, not shown, through feed point 12. When a person is making a call with mobile phone 1*a* on the ear, the direction in which antenna 21 extends is approximately at 30° (a zenith angle 30°) with respect to a vertical direction. Antenna 21 is contained in housing 10.

Figure 3:
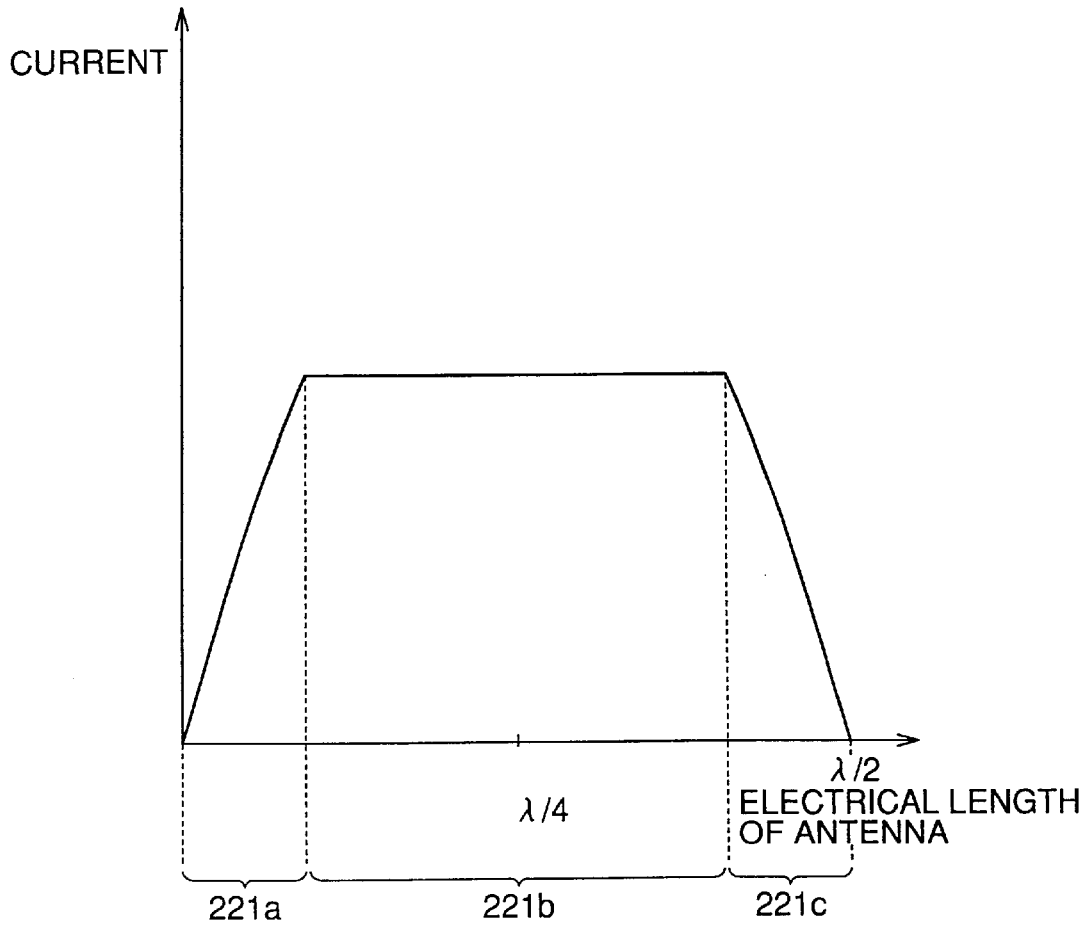
FIG. 3 is a graph showing the relation between the electrical length of the antenna and the current in the mobile phone shown in FIGS. 1 and 2.

FIG. 3 is a graph showing the relation between the electrical length of the antenna and the current in mobile phone 1*a* shown in FIGS. 1 and 2. Referring to FIG. 3, regions 221*a* and 221*c* correspond to regions where meander line antennas 21*a* and 21*c* exist, while region 221*b* corresponds to a region where plate antenna 21*b* exists. As shown in FIG. 3, it is understood that provision of plate antenna 21*b* in region 221*b* where the current becomes larger can prevent the current value increase in this portion.

In mobile phone 1*a* and antenna device 3*a* thus configured, first, meander line antennas 21*a* and 21*c* receive and transmit either a vertically or horizontally polarized wave and plate antenna 21*b* receives and transmits both the vertically and horizontally polarized waves. As a result, both the vertically and horizontally polarized waves can be received and transmitted, thereby preventing degradation in gain. Furthermore, as shown in FIG. 3, it is possible to decrease the current value at the central portion of the antenna, so that degradation in gain can be prevented even when this portion is touched by a finger or the like.

In addition, antenna 21 is contained in housing 10, so that antenna 21 is not in direct contact with a human body. As a result, antenna 21 is less affected by a human body and therefore degradation in gain due to a human body can be prevented.

(Second Embodiment)

Figure 4:
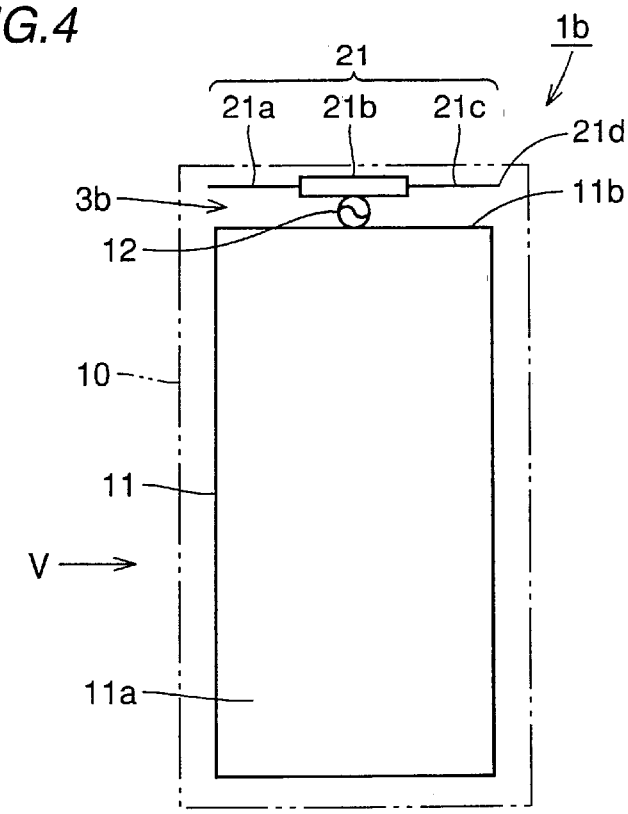
FIG. 4 is a schematic plan view of the mobile phone having the antenna device in accordance with a second embodiment of the present invention.
Figure 5:
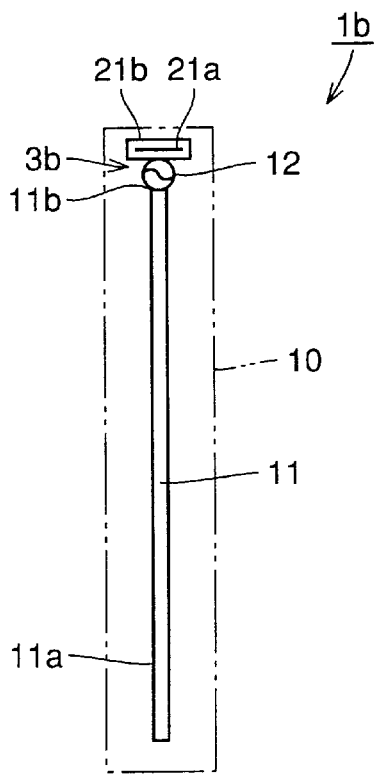
FIG. 5 is a side view of the mobile phone seen from a direction indicated by an arrow V in FIG. 4.

FIG. 4 is a schematic plan view of the mobile phone having the antenna device in accordance with a second embodiment of the present invention. FIG. 5 is a side view of the mobile phone seen from a direction indicated by an arrow V in FIG. 4. Referring to FIGS. 4 and 5, a mobile phone 1*b* and an antenna device 3*b* in accordance with the second embodiment of the present invention differs from antenna device 3*a* illustrated in the first embodiment in that antenna 21 is provided on a zenith plane 11*b* as a side surface of substrate 11. Antenna 21 is connected to feed point 12.

First, antenna device 3*b* and mobile phone 1*b* thus configured has an effect similar to that of antenna device 3*a* and mobile phone 1*b* illustrated in the first embodiment. In addition, since antenna 21 is provided on zenith plane 11*b*, an area available on main surface 11*a* is increased as compared with antenna 21 provided on main surface 11*a*. As a result, other components can be placed on main surface 11*a*.

(Third Embodiment)

Figure 6:
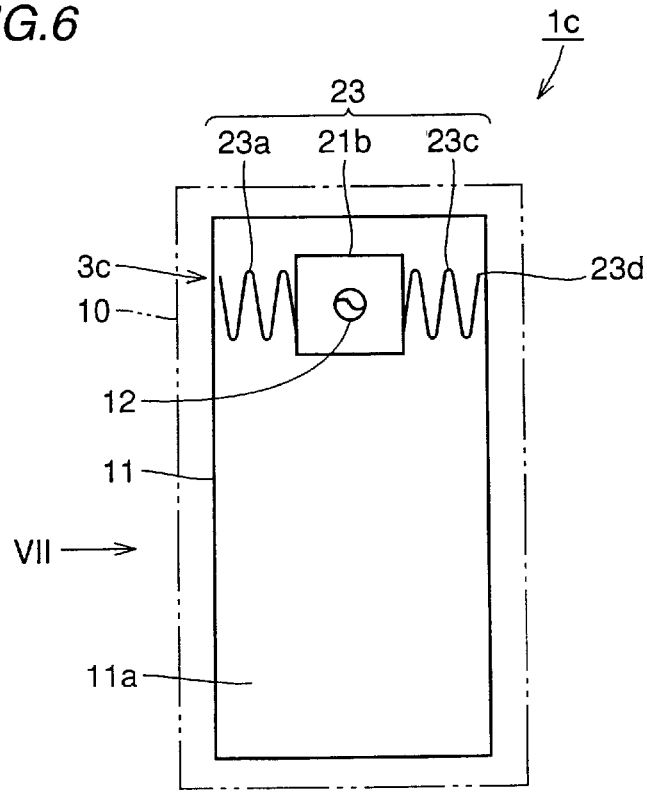
FIG. 6 is a schematic plan view of the mobile phone having the antenna device in accordance with a third embodiment of the present invention.
Figure 7:
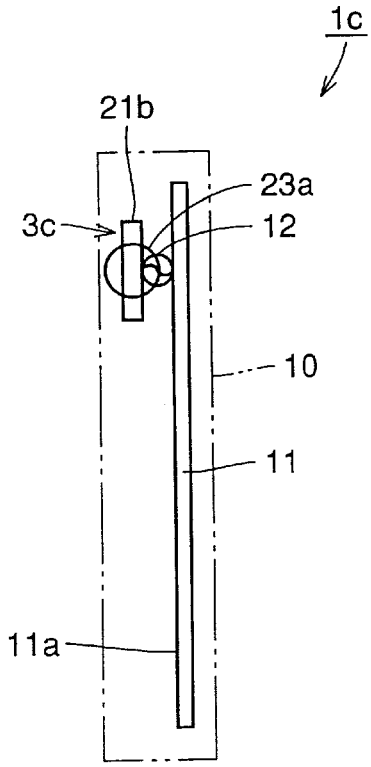
FIG. 7 is a side view of the mobile phone seen from a direction indicated by an arrow VII in FIG. 6.

FIG. 6 is a schematic plan view of the mobile phone having the antenna device in accordance with a third embodiment of the present invention. FIG. 7 is a side view of the mobile phone seen from a direction indicated by an arrow VII in FIG. 6. Referring to FIGS. 6 and 7, a mobile phone 1*c* and an antenna device 3*c* in accordance with the third embodiment of the present invention differs from mobile phone 1*a* and antenna device 3*a* illustrated in the first embodiment in that a linear antenna portion of an antenna 23 is configured with helical antennas 23*a* and 23*c*. Helical antennas 23*a* and 23*c* are configured in a helical manner and has one end connected to plate antenna 21*b*. Helical antennas 23*a* and 23*c* are provided in a spiral manner and are not in direct contact with substrate 11.

Mobile phone 1*c* has housing 10 and antenna device 3*c* contained in housing 10. Antenna device 3*c* includes substrate 11 and antenna 23 provided on substrate 11 and having an electrical length of $(\lambda/2)\times A$ (A is an integer). Antenna 23 has plate antenna 21*b* as a plate antenna portion positioned at a portion where an electrical length from an end portion 23*d* is approximately $\lambda/4+(\lambda/2)\times B$ (B is an integer), and helical antennas 23*a* and 23*c* as a linear antenna portion connected to plate antenna 21*b*.

Antenna device 3*c* and mobile phone 1*c* thus configured has an effect similar to that of antenna device 3*a* and mobile phone 1*c* illustrated in the first embodiment.

(Fourth Embodiment)

Figure 8:
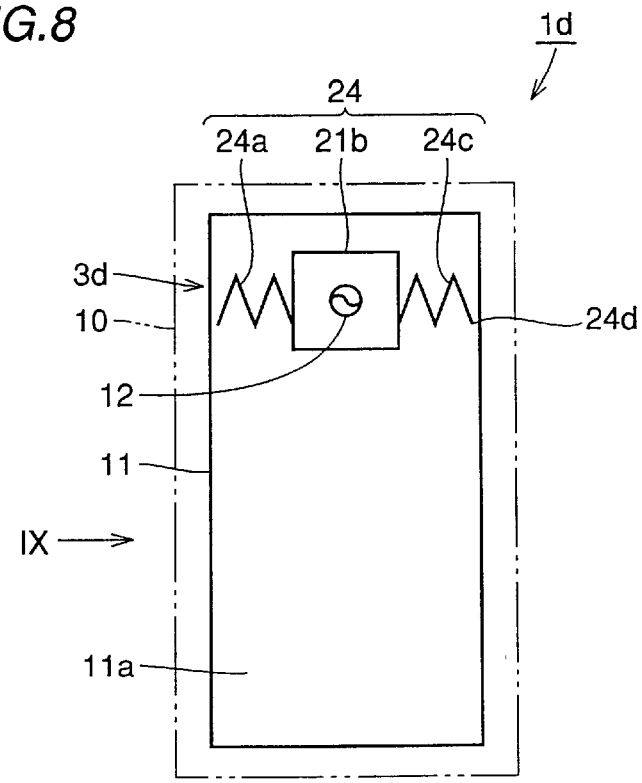
FIG. 8 is a schematic plan view of the mobile phone having the antenna device in accordance with a fourth embodiment of the present invention.
Figure 9:
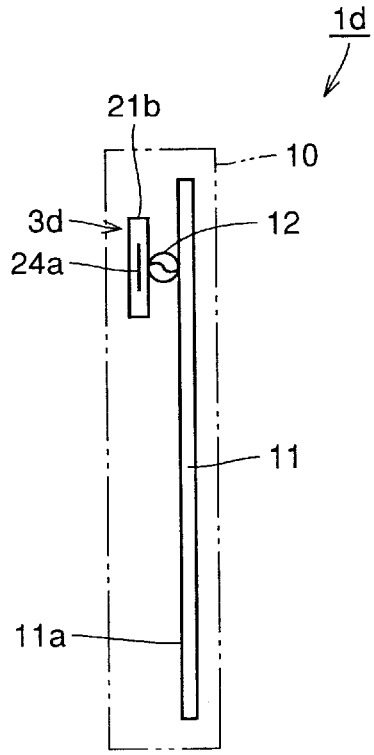
FIG. 9 is a side view of the mobile phone seen from a direction indicated by an arrow IX in FIG. 8.

FIG. 8 is a schematic plan view of the mobile phone having the antenna device in accordance with a fourth embodiment of the present invention. FIG. 9 is a side view of the mobile phone seen from a direction indicated by an arrow IX in FIG. 8. Referring to FIGS. 8 and 9, an antenna device 3*d* in accordance with the fourth embodiment of the present invention differs from antenna 21 illustrated in the first embodiment in that an antenna 24 is configured with zigzag antennas 24*a* and 24*c* and plate antenna 21*b*.

More specifically, mobile phone 1*d* has housing 10 and antenna device 3*d* contained in housing 10. Antenna device 3*d* includes substrate 11 and antenna 24 provided on substrate 11 and having an electrical length of $(\lambda/2)\times A$ (A is an integer). Antenna 24 has plate antenna 21*b* as a plate antenna portion positioned at a portion where an electrical length from an end portion 24*d* is approximately $\lambda/4+(\lambda/2)\times B$ (B is an integer), and zigzag antennas 24*a* and 24*c* as a linear antenna portion connected to plate antenna 21*b*.

Antenna device 3*d* and mobile phone 1*d* thus configured also has an effect similar to that of antenna device 3*a* and mobile phone 1*a* illustrated in the first embodiment.

(Fifth Embodiment)

Figure 10:
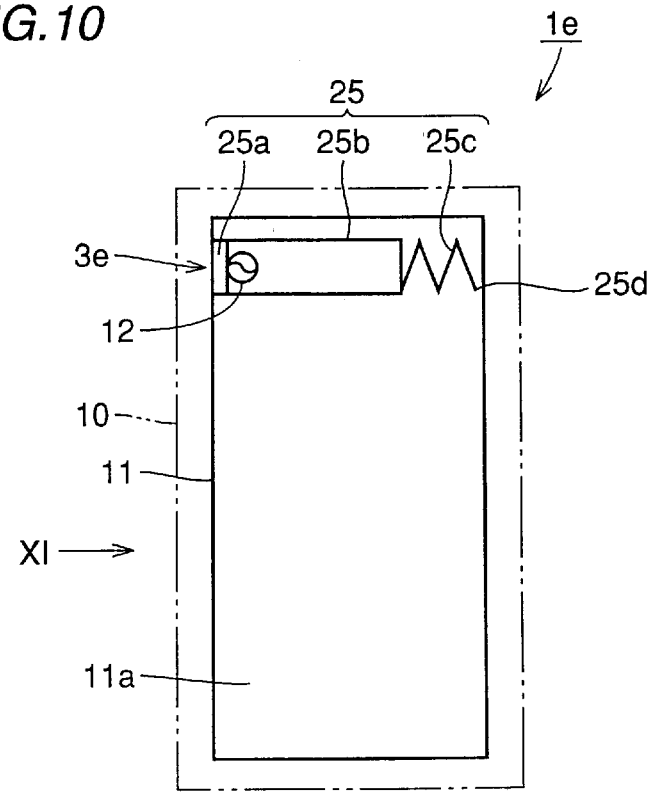
FIG. 10 is a schematic plate view of the mobile phone having the antenna device in accordance with a fifth embodiment of the present invention.
Figure 11:
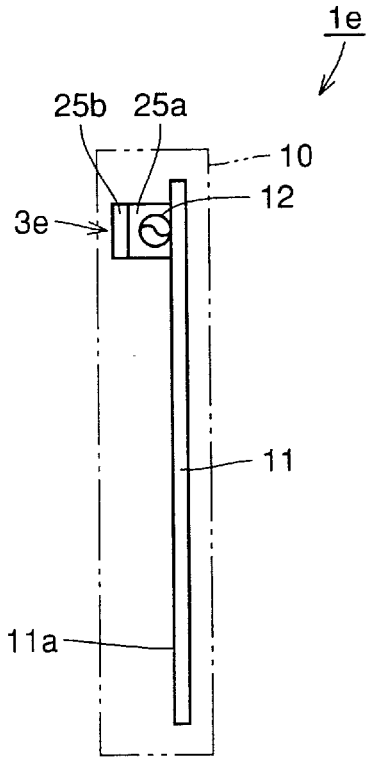
FIG. 11 is a side view of the mobile phone seen from a direction indicated by an arrow XI in FIG. 10.

FIG. 10 is a plan view of the mobile phone having the antenna device in accordance with a fifth embodiment of the present invention. FIG. 11 is a side view of the mobile phone seen from a direction indicated by an arrow XI in FIG. 10.

Referring to FIGS. 10 and 11, a mobile phone 1*e* has housing 10 and an antenna device 3*e* contained in housing 10. Antenna device 3*e* includes substrate 11 and an antenna 25 provided on substrate 11 and having an electrical length of $(\lambda/2)\times A$ (A is an integer). Antenna 25 has a connection portion 25*a* as a plate antenna portion positioned at a portion where an electrical length from an end portion 25*d* is approximately $\lambda/4+(\lambda/2)\times B$ (B is an integer), a plate antenna 25*b* and a zigzag antenna 25*c* as a linear antenna portion connected to connection portion 25*a* through plate antenna 25*b*.

Antenna 25 is provided on main surface 11*a* of substrate 11. Antenna 25 has connection portion 25*a* connected to main surface 11*a*, plate antenna 25*b* connected to connection portion 25*a*, and zigzag antenna 25*c* connected to plate antenna 25*b*. Connection portion 25*a* is formed of a plate antenna and connects main surface 11*a* having conductivity to plate antenna 25*b*. Connection portion 25*a* is also connected to feed point 12. Plate antenna 25*b* is provided as opposed to main surface 11*a* and has one end connected to connection portion 25*a* and the other end connected to zigzag antenna 25*c*. Since connection portion 25*a* is connected to main surface 11*a* having conductivity, an image of the antenna is formed also on main surface 11*a*. Therefore, although the physical length of antenna 25 is $(\lambda/4)\times A$ (A is an integer), the electrical length is $(\lambda/2)\times A$ (A is an integer).

First, antenna device 3*e* and mobile phone 1*e* thus configured has an effect similar to that of antenna device 3*a* and mobile phone 1*a* illustrated in the first embodiment. In addition, antenna device 3*e* and mobile phone 1*e* can be reduced in size, since the physical length of antenna 25 is reduced.

It is noted that although plate antenna 25*b* is connected with zigzag antenna 25*c* in this embodiment, plate antenna 25*b* may be connected with a monopole antenna, a meander line antenna and a helical antenna.

(Sixth Embodiment)

Figure 12:
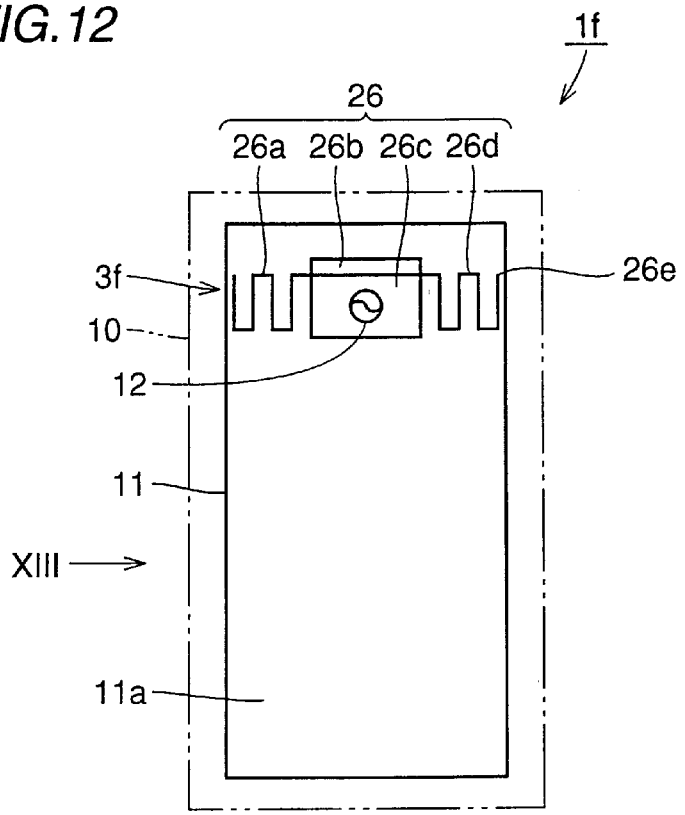
FIG. 12 is a schematic plan view of the mobile phone having the antenna device in accordance with a sixth embodiment of the present invention.
Figure 13:
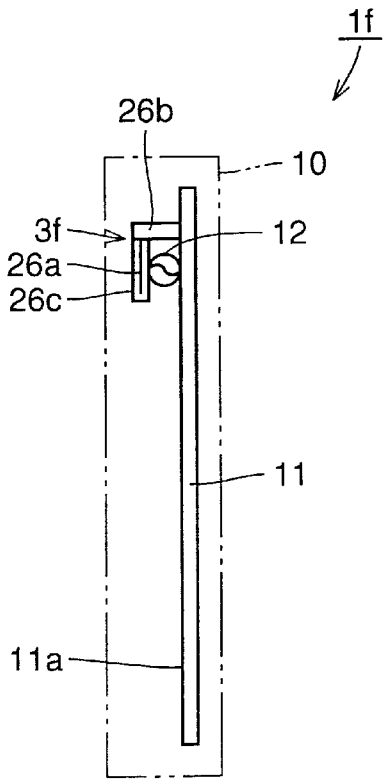
FIG. 13 is a side view of the mobile phone seen from a direction indicated by an arrow XIII in FIG. 12.

FIG. 12 is a plan view of the mobile phone having the antenna device in accordance with a sixth embodiment of the present invention. FIG. 13 is a side view of the mobile phone seen from a direction indicated by an arrow XIII in FIG. 12. Referring to FIGS. 12 and 13, a mobile phone 1*f* has housing 10 and an antenna device 3*f* contained in housing 10. Antenna device 3*f* includes substrate 11 and an antenna 26 provided on substrate 11 and having an electrical length of $(\lambda/2)\times A$ (A is an integer). Antenna 26 has a plate antenna 26*c* as a plate portion positioned at a portion where an electrical length from an end portion 26*e* is approximately $\lambda/4+(\lambda/2)\times B$ (B is an integer), meander line antennas 26*a* and 26*d* as a linear antenna portion connected to plate antenna 26*c*, and a connection portion 26*b*.

Plate antenna 26*c* is connected to feed point 12 and also to connection portion 26*b*. Connection portion 26*b* connects plate antenna 26*c* to main surface 11*a* having conductivity. Both meander line antennas 26*a* and 26*d* and plate antenna 26*c* are provided as opposed to main surface 11*a*. Antenna 26 is connected to main surface 11*a* at connection portion 26*b*. Therefore, an image of antenna 26 is formed on main surface 11*a*. Although the physical length of antenna 26 is $(\lambda/4)\times A$ (A is an integer), the electrical length is $(\lambda/2)\times A$ (A is an integer). Plate antenna 26*c* is provided at the central portion of antenna 26, specifically at a portion where the current value is maximized in antenna 26.

Antenna device 3*f* and mobile phone 1*f* thus configured also has an effect similar to that of antenna device 3*e* and mobile phone 1*e* illustrated in the fifth embodiment.

Now, the specific effect of the present invention will be described.

Figure 14:
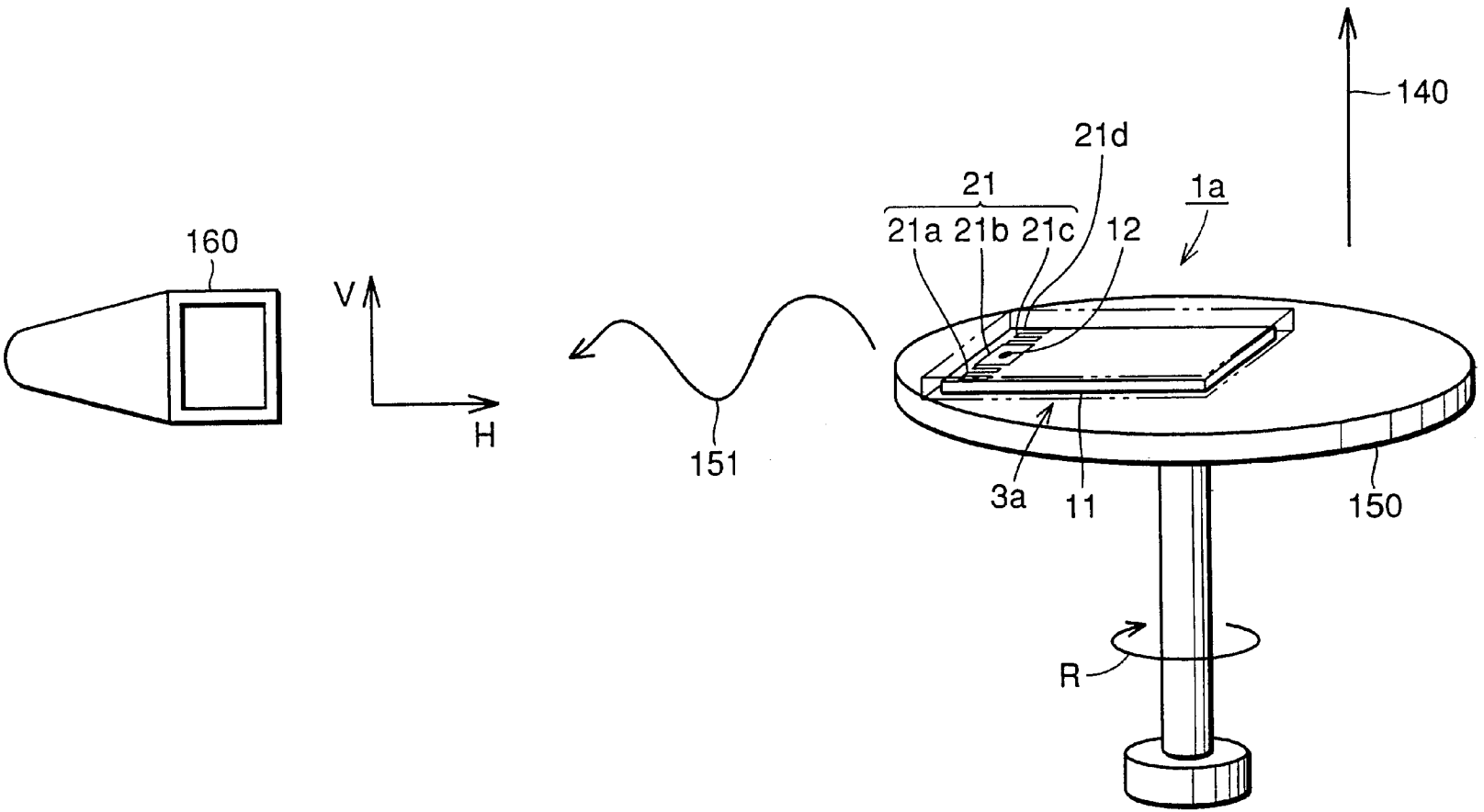
FIG. 14 shows the step of measuring a radiation pattern in Y-Z plane.
Figure 15:
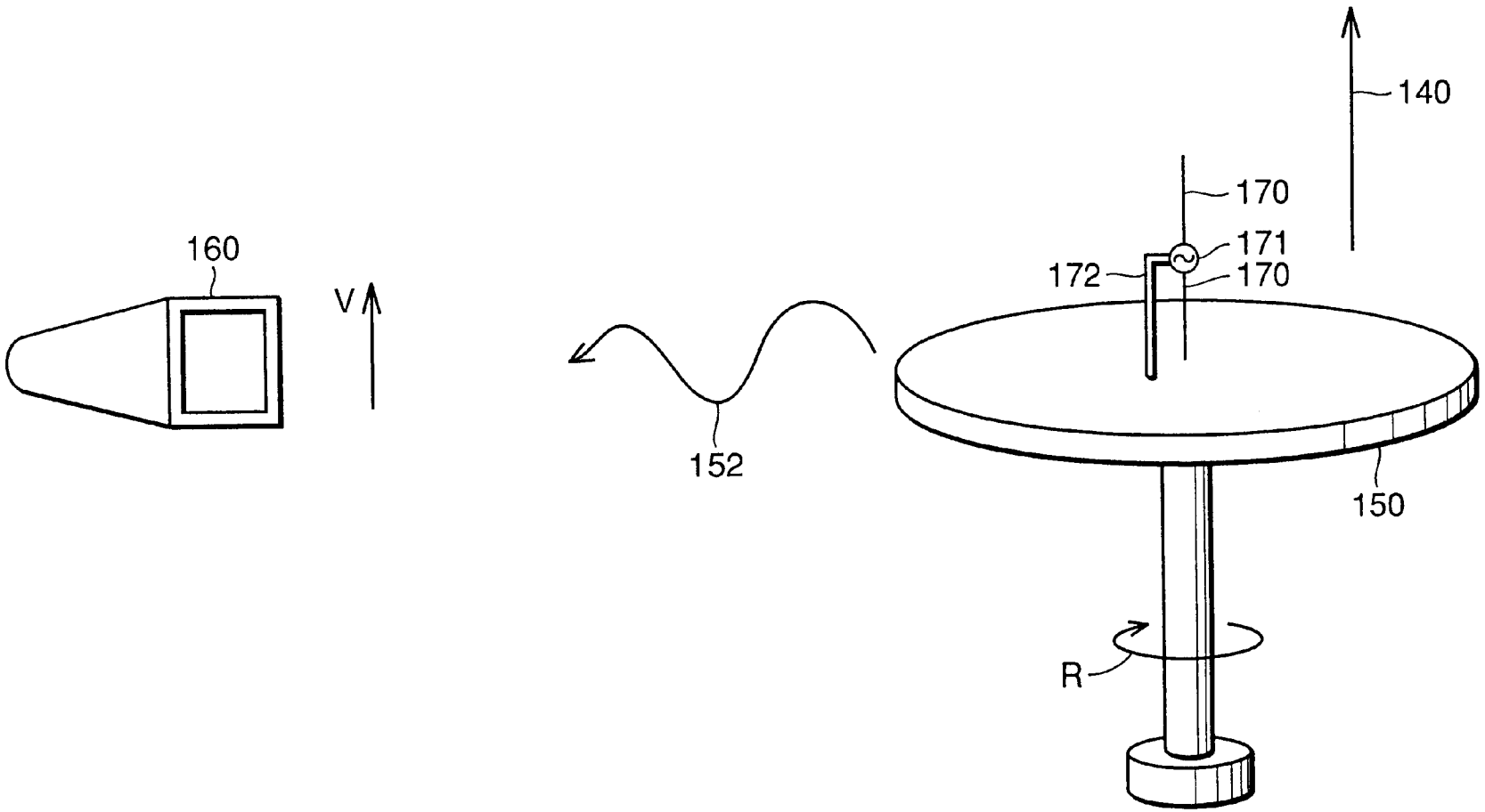
FIG. 15 shows the step of measuring a radiation pattern in Y-Z plane.
Figure 16:
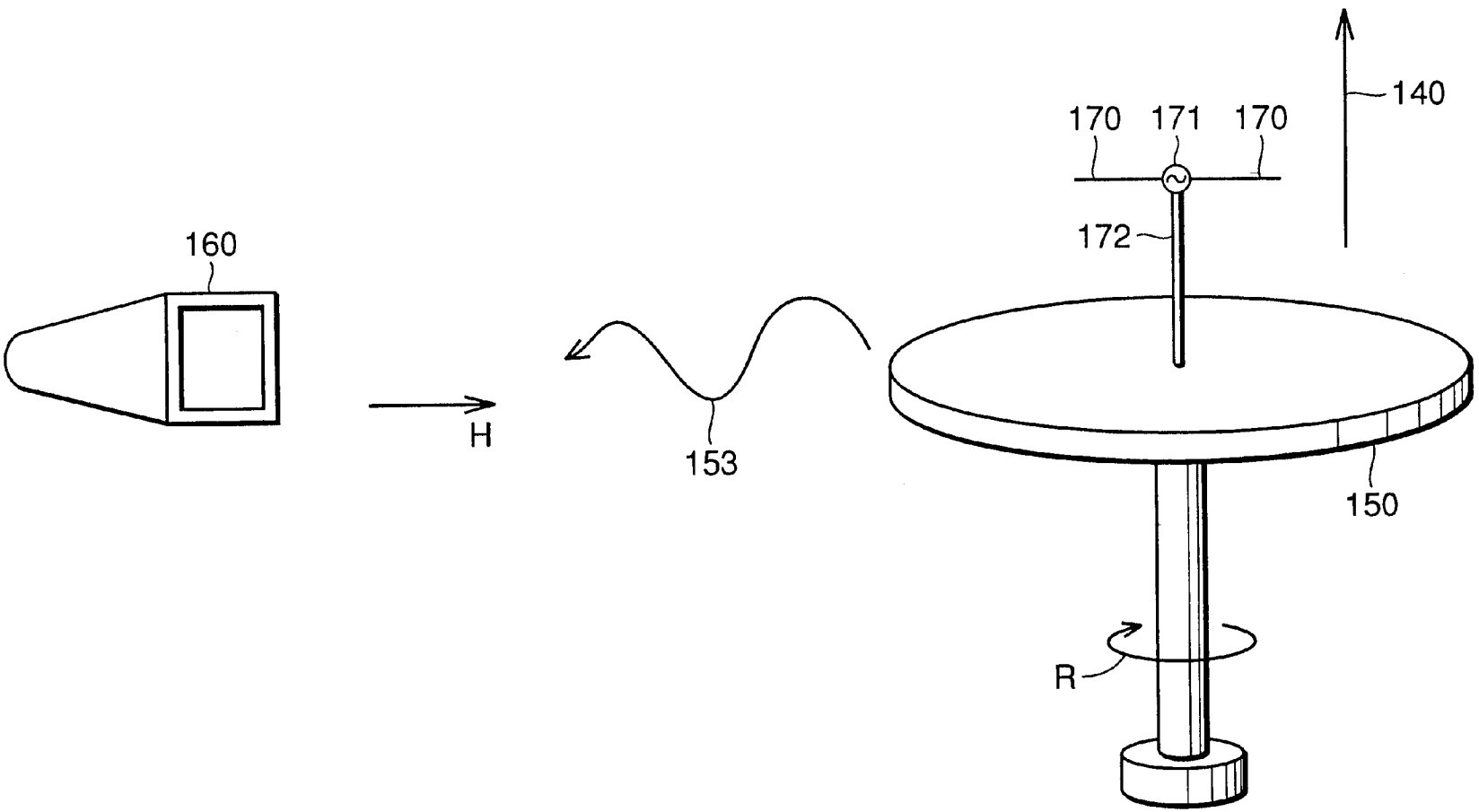
FIG. 16 shows the step of measuring a radiation pattern in Y-Z plane.

FIGS. 14 to 16 show the steps of measuring radiation patterns in Y-Z plane. Referring to FIG. 14, mobile phone 1*a* (FIG. 1) illustrated in the first embodiment was first prepared. The electrical length of antenna 21 was $\lambda/2$. Plate antenna 21*b* was arranged at a position where the electrical length is $\lambda/4$ from the end portion 21*d* of the antenna. Here, mobile phone 1*a* was placed on a table 150 such that a Y direction (a direction in which the shorter side of substrate 11 extends) and a Z direction (a direction in which the longer side of substrate 11 extends), as shown in FIG. 1, were on a horizontal plane. Furthermore, X direction was in a vertical direction indicated by an arrow 140. Table 150 was rotatable in a direction indicated by arrow R.

With mobile phone 1*a* being placed on table 150 in this manner, a radio wave at a frequency of 1.95 GHz was radiated at a prescribed power from the radio transceiver unit on substrate 11 through antenna device 3*a*. Then, table 150 was rotated in the direction indicated by arrow R. Accordingly, antenna device 3*a* radiated a radio wave as indicated by an arrow 151. The field intensity of this radio wave was measured by an measuring antenna 160 and the field intensity was found for a vertically polarized wave in a direction indicated by an arrow V and a horizontally polarized wave in a direction indicated by an arrow H for this radio wave.

Referring to FIG. 15, a dipole antenna 170 was placed on table 150. Dipole antenna 170 is provided with a feed point 171 at the central portion, and feed point 171 is connected to a coaxial cable 172. Coaxial cable 172 is connected to a prescribed radio transceiver unit. Dipole antenna 170 extends approximately parallel to the vertical direction indicated by an arrow 140. With table 150 being rotated in a direction indicated by arrow R, similar power as provided by the radio transceiver unit to antenna 3*a* shown in FIG. 14 was provided to dipole antenna 170 so that a radio wave at a frequency of 1.95 GHz as indicated by an arrow 152 was radiated from dipole antenna 170. Accordingly, the radio wave indicated by arrow 152 was radiated from dipole antenna 170. This radio wave is a vertically polarized wave in a direction shown by arrow V. The field intensity of this radio wave was measured by measuring antenna 160.

Referring to FIG. 16, similar power as provided by the radio transceiver unit to antenna device 3*a* was provided to dipole antenna 170 so that a radio wave at a frequency of 1.95 GHz as indicated by arrow 153 was radiated from dipole antenna 170. This radio wave is a horizontally polarized wave in a direction indicated by an arrow H. The field intensity of this radio wave was obtained by measuring antenna 160.

The radiation pattern of the antenna device in accordance with the present invention was obtained based on data obtained form the steps shown in FIGS. 14–16. The result is shown in FIG. 17.

Figure 17:
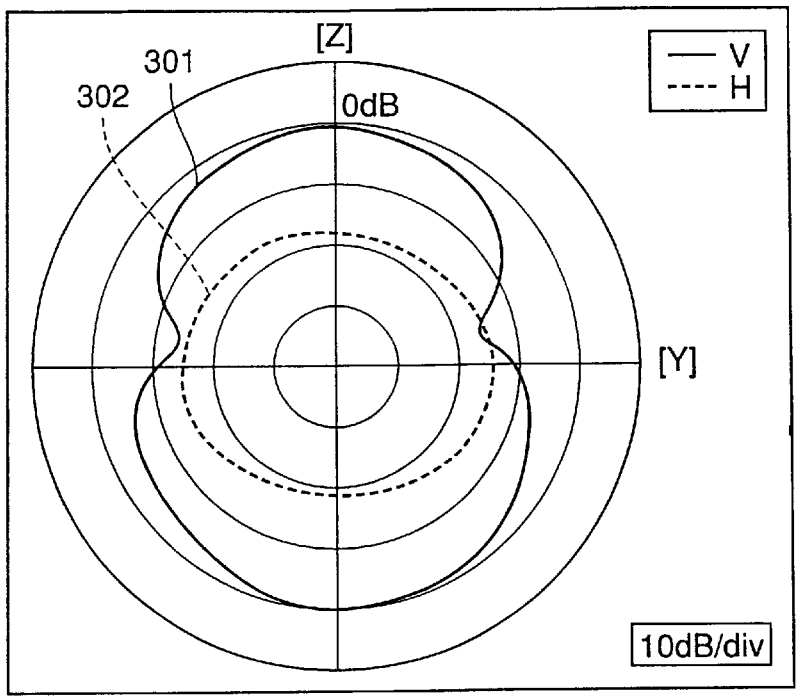
FIG. 17 is a graph showing a radiation pattern in Y-Z plane in the product of the present invention.

In FIG. 17, a solid line 301 shows the gain of the vertically polarized wave component of the radio wave radiated from antenna device 3*a* shown in FIG. 14, with respect to the field intensity of the vertically polarized wave radiated from dipole antenna 170 in the step shown in FIG. 15. This gain was calculated according to the following formula.

(gain)=$20\times\log_{10}$ (the field intensity of the vertically polarized wave from antenna device 3*a*/the field intensity of the vertically polarized wave from dipole antenna 170)

A dotted line 302 shows the gain of the horizontally polarized wave component of the radio wave radiated from antenna device 3*a* shown in FIG. 14, with respect to the field intensity of the horizontally polarized wave radiated from dipole antenna 170 in the step shown in FIG. 16. This gain was calculated according to the following formula.

(gain)=$20\times\log_{10}$ (the field intensity of the horizontally polarized wave from antenna device 3*a*/the field intensity of the horizontally polarized wave from dipole antenna 170)

As seen from FIG. 17, in antenna device 3*a* in accordance with the present invention, the gain of the vertically polarized wave is relatively uniform in all directions. Furthermore, the gain of the horizontally polarized wave is also generally uniform in all directions. Therefore, it is appreciated that various polarized waves can be received and transmitted.

Figure 18:
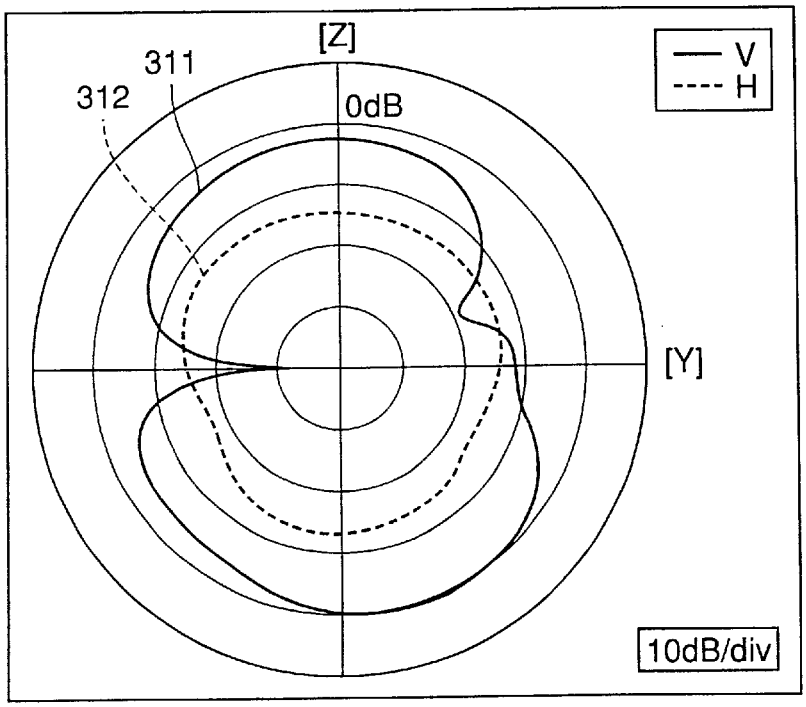
FIG. 18 is a graph showing a radiation pattern in Y-Z plane for a conventional mobile phone shown in FIG. 20.
Figure 20:
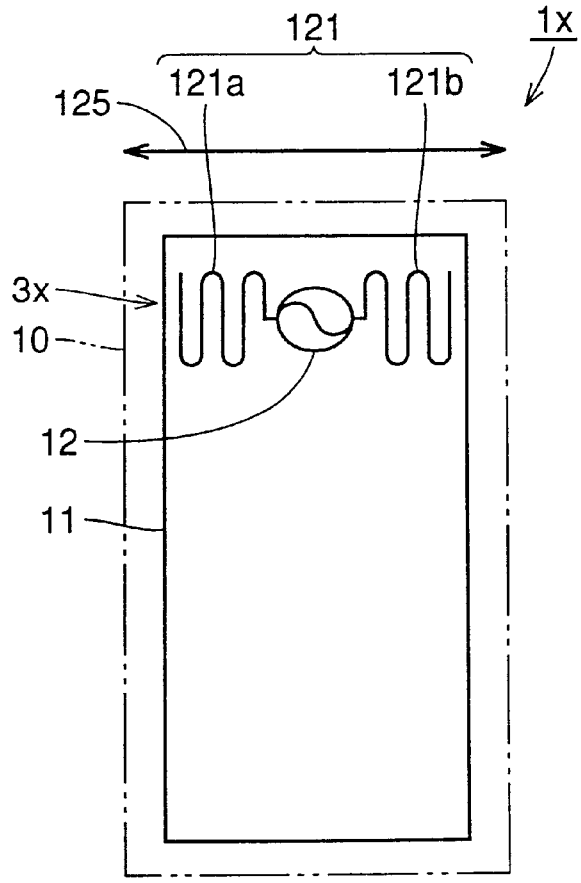
FIG.20 PRIOR ART
FIG. 20 is a schematic plan view of the mobile phone containing a conventional dipole antenna.
Figure 21:
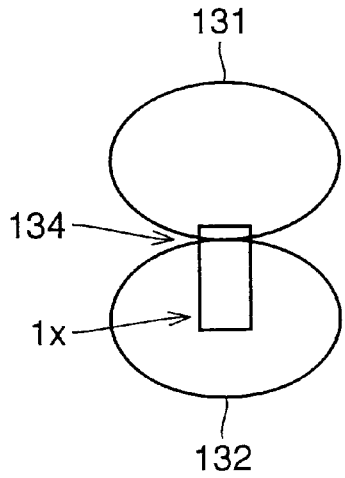
FIG.21 PRIOR ART
FIG. 21 shows a radiation pattern of the mobile phone shown in FIG. 20.
Figure 22:
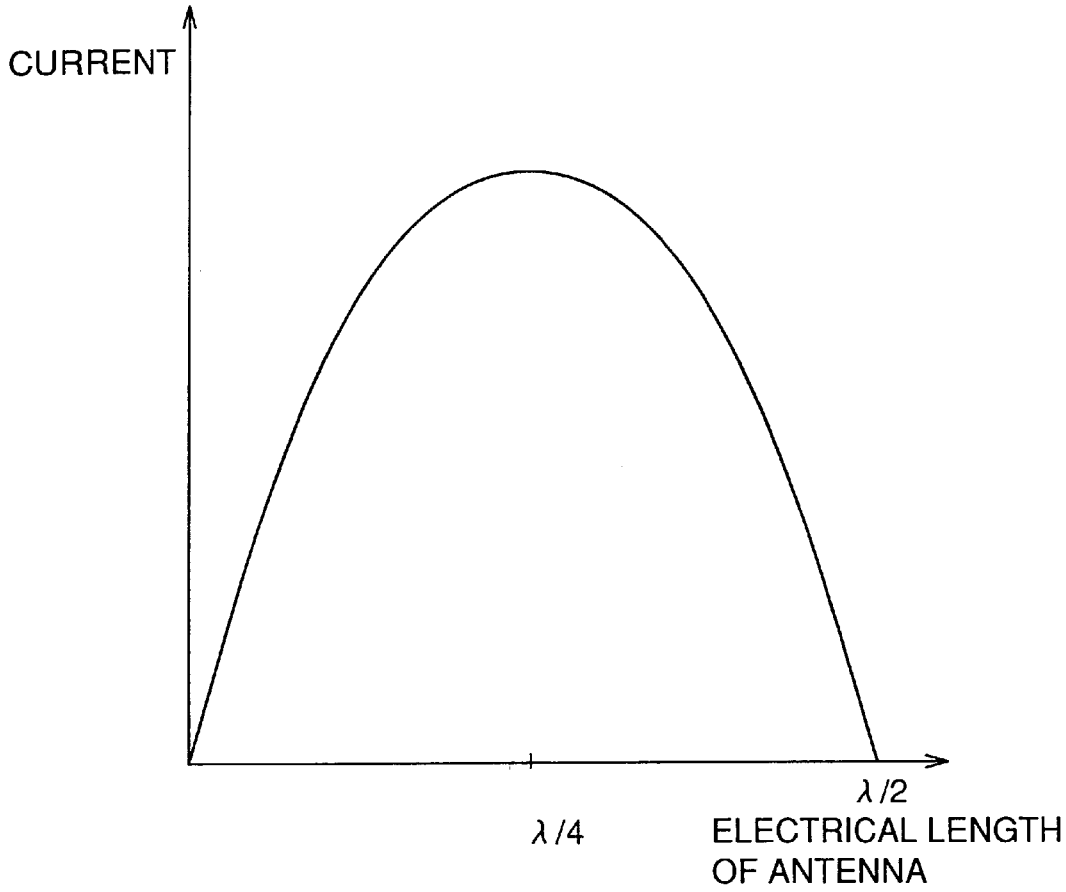
FIG.22 PRIOR ART
FIG. 22 is a graph showing the relation between the electrical length of the antenna shown in FIG. 20 and the current distribution on the antenna element.

Next, mobile phone 1*x* having the conventional antenna device 3*x* shown in FIG. 20 was used and placed on table 150 with Y-axis and X-axis oriented in the horizontal direction and with X-axis parallel to the vertical direction in accordance with the step shown in FIG. 14. In this state, with table 150 being rotated in the direction indicated by arrow R, a radio wave at a frequency of 1.95 GHz was radiated through antenna device 3*x*. At this point, similar power as provided by the radio transceiver unit to antenna device 3*a* was provided to antenna device 3*x*. The vertically polarized wave component and the horizontally polarized wave component of this radiated radio wave were measured by measuring antenna 160. The radiation pattern for such a conventional antenna is shown in FIG. 18. In FIG. 18, a solid line 311 shows the gain of the field intensity of the vertically polarized wave component of the radio wave radiated from antenna device 3*x* in accordance with the step shown in FIG. 14, with respect to the field intensity of the vertically polarized wave measured in the step shown in FIG. 15. This gain was calculated according to the following formula.

(gain)=$20\times\log_{10}$ (the field intensity of the vertically polarized wave from antenna device 3*x*/the field intensity of the vertically polarized wave from dipole antenna 170)

A dotted line 312 shows the gain of the field intensity of the horizontally polarized wave component of the radio wave radiated from antenna device 3*x* in accordance with the step shown in FIG. 14, with respect to the field intensity of the horizontally polarized wave measured in the step shown in FIG. 16. This gain was calculated according to the following formula.

(gain)=20×$\log_{10}$ (the field intensity of the horizontally polarized wave from antenna device 3*x*/the field intensity of the horizontally polarized wave from dipole antenna 170)

As seen from FIG. 18, the gain of the vertically polarized wave is extremely small in the Y-axis direction in the conventional one.

Figure 19:
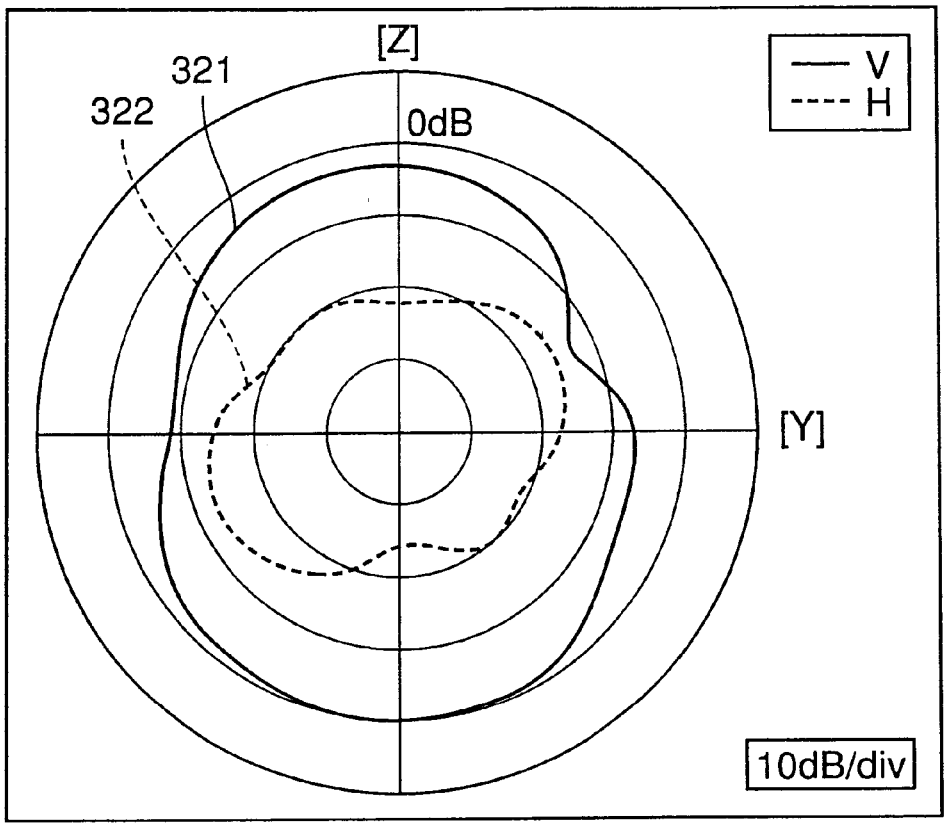
FIG. 19 is a graph showing a radiation pattern in Y-Z plane for a conventional mobile phone shown in FIG. 23.
Figure 23:
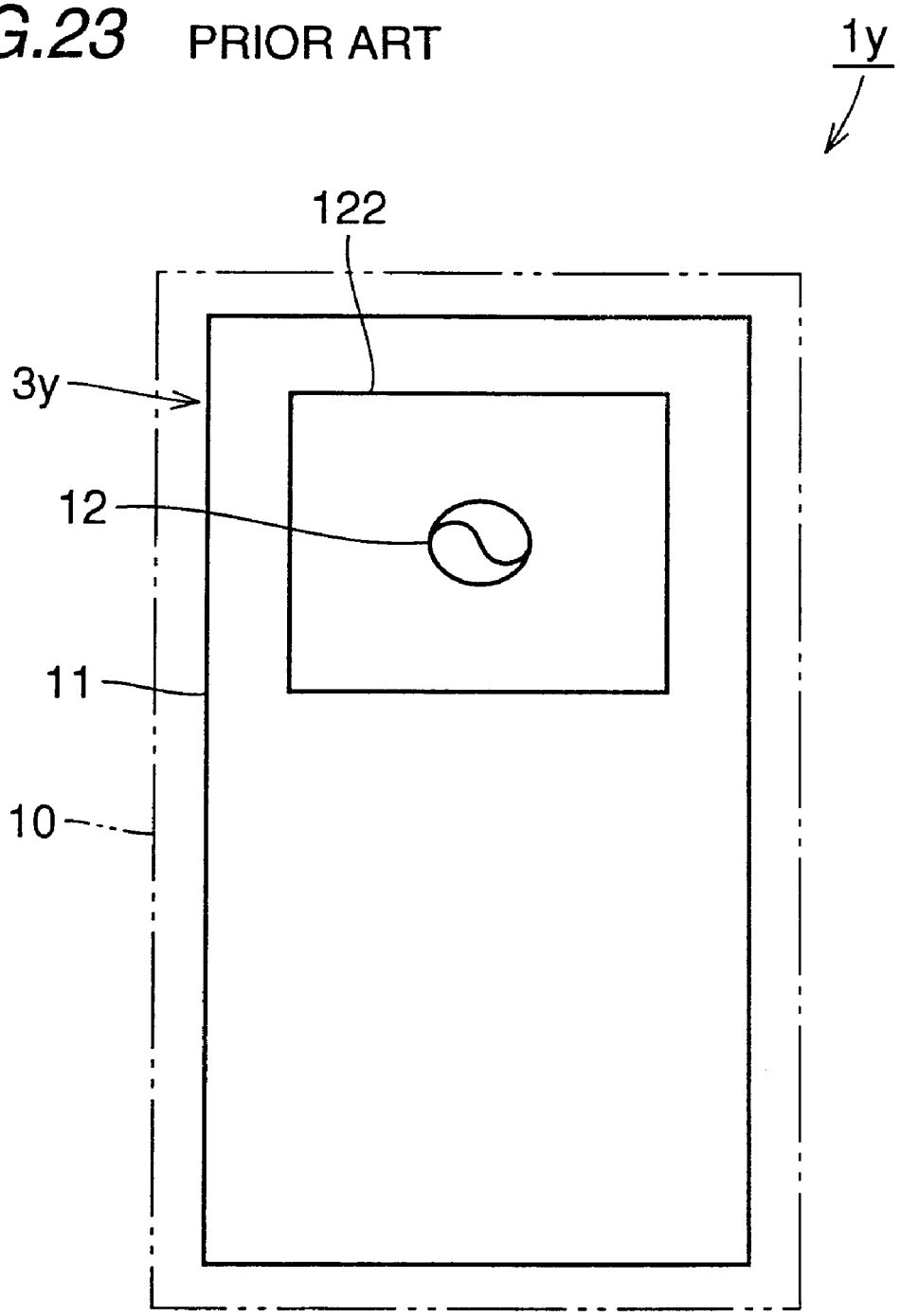
FIG.23 PRIOR ART
FIG. 23 is a schematic plan view of the mobile phone having a conventional plate antenna.

Then, mobile phone 1*y* having the conventional antenna device 3*y* shown in FIG. 23 was used and placed on table 150 with Y-axis and Z-axis oriented in the horizontal direction and with X-axis in parallel to the vertical direction in accordance with the similar step as shown in FIG. 14. In this state, with table 150 being rotated in the direction indicated by arrow R, a radio wave at a frequency of 1.95 GHz was radiated through antenna device 3*y*. At this point, similar power as provided by the radio transceiver unit to antenna device 3*a* was provided to antenna device 3*y*. The vertically polarized wave component and the horizontally polarized wave component of this radiated radio wave were measured by measuring antenna 160. The radiation pattern for such a conventional antenna is shown in FIG. 19. In FIG. 19, a solid line 321 shows the gain of the field intensity of the vertically polarized wave component of the radio wave radiated from antenna device 3*y* in accordance with the step shown in FIG. 14, with respect to the field intensity of the vertically polarized wave measured in the step shown in FIG. 15. This gain was calculated according to the following formula.

(gain)=20×$\log_{10}$ (the field intensity of the vertically polarized wave from antenna device 3*y*/the field intensity of the vertically polarized wave from dipole antenna 170)

A dotted line 322 shows the gain of the field intensity of the horizontally polarized wave component of the radio wave radiated from antenna device 3*y* in accordance with the step shown in FIG. 14, with respect to the field intensity of the horizontally polarized wave measured in the step shown in FIG. 16. This gain was calculated according to the following formula.

(gain)=20×$\log_{10}$ (the field intensity of the horizontally polarized wave from antenna device 3*y*/the field intensity of the horizontally polarized wave from dipole antenna 170)

As seen from FIG. 18, when the plate antenna is used, radio waves can be received and transmitted relatively from every direction.

This plate antenna 122, however, has a problem in that the total perimeter of the antenna is λ and the mobile phone is increased in size.

Then, the gains were measured when a person made a call holding the aforementioned mobile phones 1*a*, 1*x* and 1*y* at either the right or left hand. Here, given that the gain was 0 dB when the person made a call holding mobile phone 1*a* at the left hand, the gains were measured respectively for the samples held at either the left hand or the right hand. The result is shown in Table 1.

TABLE 1

| | gains during call | |
|---|---|---|
| sample | held at the left hand | held at the right hand |
| 1a | 0 | −0.03 |
| 1x | −2.63 | −0.09 |
| 1y | −3.84 | +0.72 |

As seen from Table 1, in mobile phone 1*a* of the present invention, gain variations are small whether the mobile phone is held at the right or left hand. On the contrary, it can be observed that in mobile phone 1*x*, the gain is decreased compared with the present invention product when it is held at either the right hand or the left hand. Furthermore, in mobile phone 1*y*, the gain is increased compared with the present invention when it is held at the right hand, whereas the gain is significantly degraded when it is held at the left hand. Therefore, the gain variations are large. Accordingly, it is appreciated that in the present invention the gain variations are reduced whether the mobile phone is held at the right or left hand.

Furthermore, the maximum field intensity was obtained in the vicinity of the antenna for each of mobile phones 1*a*, 1*x* and 1*y*. Given that the maximum field intensity in mobile phone 1*a* was 100%, the field intensity in mobile phone 1*x* was 130% and the maximum field intensity in mobile phone 1*y* was 68%. Therefore, even when a person touches the vicinity of the antenna, the electric field is less affected by the action of the person, because concentration of the electric field is relieved in the present invention as compared with mobile phone 1*x*. As a result, decrease in gain can be prevented.

It is noted that a monopole antenna can be used as a linear antenna in all the embodiments described above. In order to reduce the mobile phone in size, it is preferable that the electrical length of antennas 21, 23, 24 is λ/2 in the first to fourth embodiments.

INDUSTRIAL APPLICABILITY

The antenna device and the mobile phone in accordance with the present invention can be utilized in the field of mobile phones containing antennas.

What is claimed is:

1. An antenna device comprising:

a substrate; and an antenna provided on said substrate and having an electrical length of approximately (λ/2)×A (A is an integer), wherein said antenna includes a plate antenna portion positioned at a portion where an electrical length from an end portion is approximately λ4+(λ/2)×B (B is an integer), and a linear antenna portion connected to said plate antenna portion.

2. The antenna device according to claim 1, wherein said linear antenna portion includes at least one selected from the group consisting of a monopole antenna, a zigzag antenna, a meander line antenna, and a helical antenna.

3. The antenna device according to claim 1, wherein said substrate has a main surface having conductivity, and said antenna further includes a connection portion connected to said main surface of said substrate.

4. The antenna device according to claim 1, wherein said substrate has a main surface and a side surface continuous with the main surface, and said antenna is provided on said side surface.

5. A mobile terminal comprising:

a housing; and an antenna device contained in said housing, wherein said antenna device includes a substrate, and an antenna provided on said substrate and having an electrical length of approximately $(\lambda/2)\times A$ (A is an integer), and said antenna includes a plate antenna portion positioned at a portion where an electrical length from an end portion is approximately $\lambda/4+(\lambda/2)\times B$ (B is an integer), and a linear antenna portion connected to said plate antenna portion.

6. The mobile terminal according to claim 5, wherein said linear antenna portion includes at least one selected from the group consisting of a monopole antenna, a zigzag antenna, a meander line antenna, and a helical antenna.

7. The mobile terminal according to claim 5, wherein said substrate has a main surface having conductivity, and said antenna further includes a connection portion connected to said main surface of said substrate.

8. The mobile terminal according to claim 5, wherein said substrate has a main surface and a side surface continuous with the main surface, and said antenna is provided on said side surface.

* * * * *

UNITED STATES PATENT AND TRADEMARK OFFICE

CERTIFICATE OF CORRECTION

PATENT NO. : 6,677,907 B2
DATED : January 13, 2004
INVENTOR(S) : Hideaki Shoji et al.

It is certified that error appears in the above-identified patent and that said Letters Patent is hereby corrected as shown below:

Column 10,
Line 51, change "λ4" to -- λ/4 --

Signed and Sealed this

Twenty-ninth Day of June, 2004

JON W. DUDAS
*Acting Director of the United States Patent and Trademark Office*